United States Patent [19]

Windrem

[11] Patent Number: 5,004,148

[45] Date of Patent: Apr. 2, 1991

[54] AUTOMATIC FLAG FOR RURAL MAILBOX

[76] Inventor: Ron Windrem, R.R. #5, Lindsay, Ontario, Canada, K9V 4R5

[21] Appl. No.: 507,778

[22] Filed: Apr. 12, 1990

[51] Int. Cl.[5] ..... B65D 91/00

[52] U.S. Cl. ..... 232/35; 232/34

[58] Field of Search ..... 232/35, 34, 17

[56] References Cited

U.S. PATENT DOCUMENTS

| | | | |
|---|---|---|---|
| 1,181,078 | 4/1916 | Hutchens . | |
| 1,471,364 | 10/1923 | Schrock . | |
| 1,527,686 | 2/1925 | King . | |
| 1,627,617 | 5/1927 | Nordin . | |
| 2,852,185 | 9/1958 | Stouten | 232/35 |
| 3,325,092 | 6/1967 | Hoffman et al. | 232/35 |
| 3,747,839 | 7/1973 | Morton | 232/35 |
| 4,171,086 | 10/1979 | Hudson | 232/35 |
| 4,190,193 | 2/1980 | Smith | 232/35 |
| 4,473,182 | 9/1984 | Dion | 232/35 |
| 4,756,472 | 7/1988 | Hammons | 232/35 |

*Primary Examiner*—Robert W. Gibson, Jr.

[57] ABSTRACT

The present invention relates to a mailbox flag which is used to indicate to the owner of the mailbox when the mail has been delivered. The flag itself comprises an elongated arm of at least substantially uniform weight distribution from end to end of the arm. The arm has a mounting region for pivotally mounting it to a mailbox with the mounting region being located off-center and closer to one end than the other end of the arm thereby providing long and short ends and a weight imbalance in the arm when it is mounted to the mailbox. The short end of the arm is bent, preferably at 90° to the remainder of the arm to provide an actual flag portion on the arm without affecting its weight distribution. The door of the mailbox is fitted with a catch which receives the longer end of the flag and supports it in a horizontal position. When the mailbox door is opened, the catch is pulled away from the flag which then moves through its weight imbalance to an upright position indicating that the mailbox has been opened and that the mail has been inserted by the mail man.

3 Claims, 5 Drawing Sheets

AUTOMATIC FLAG FOR RURAL MAILBOX

FIELD OF THE INVENTION

The present invention relates to a mailbox flag used to indicate that mail has been inserted into a mailbox.

BACKGROUND OF THE INVENTION

Free standing mailboxes are very popular in rural areas. The mailbox is placed at the side of the road and the "mailman" drives along and inserts the mail into the mailbox. However, the person in the house, unless he or she sees the mailman, does not know whether or not the mail has arrived.

Mail box flags have been designed to indicate that the mail has been delivered. These mailbox flags sit in a horizontally extending position prior to the mail being inserted into the mailbox. After the mail has been delivered, the flag is moved to an upright position clearly indicating delivery of the mail.

The most widely used mailbox flag is one that must be manually moved by the mailman from the horizontal to the upright position. This is both time consuming and awkward for the mailman.

A number of different automatic flags have been patented. Some examples are shown in U.S. Pat. No. 1,471,364, issued Oct. 23, 1923, U.S. Pat. No. 2,852,185, issued Sept. 16, 1958, U.S. Pat. No. 1,627,617, issued May 10, 1927, U.S. Pat. No. 1,181,078, issued Apr. 25, 1916 and U.S. Pat. No. 1,527,685, issued Feb. 24, 1925. It would appear that none of the above patented flags have made it to the marketplace, more than likely because of their complicated designs and the amount of material required to make the flags which would add substantially to the overall cost of the mailbox. Substantially all of the earlier automatic flags use a relatively long flag portion which then necessitates the use of additional weights on the bottom of the flag to move it to an upright position.

SUMMARY OF THE PRESENT INVENTION

The present invention provides an automatic mailbox flag which is both simple in design and inexpensive to manufacture. More particularly, this mailbox flag comprises an elongated arm of at least substantially uniform weight distribution from one end to the other end of the flag. The arm has a mounting region for pivotally mounting it to the mailbox with that mounting region being located off-center and closer to one end than the other end of the arm. This then provides a long and a short alm end and a natural weight imbalance in the alm when it is mounted to the mailbox. The short end of the arm is bent relative to the remainder of the arm to provide a flag portion without changing the weight imbalance o the mounted arm.

The door of the mailbox is fitted with a catch and the longer end of the arm of the flag sits on the catch to support the flag in a horizontal position with the door closed. As the door is opened, the catch is pulled away from the longer end of the arm which drops down moving the arm to a vertical position with the shorter end and the flag portion up indicating delivery of the mail.

By using an off-center mounting for the flag and with the uniform weight distribution along the length of the arm, and the flag portion simply being bent relative to the remainder of the arm, no additional weights or the like are required to move and hold it in the upright position. This is an extremely neat, simple and inexpensive design for the flag.

BRIEF DESCRIPTION OF THE DRAWINGS

The above as well as other advantages and features of the present invention will be described in greater detail according to the preferred embodiments of the present invention in which.

Figure 1:
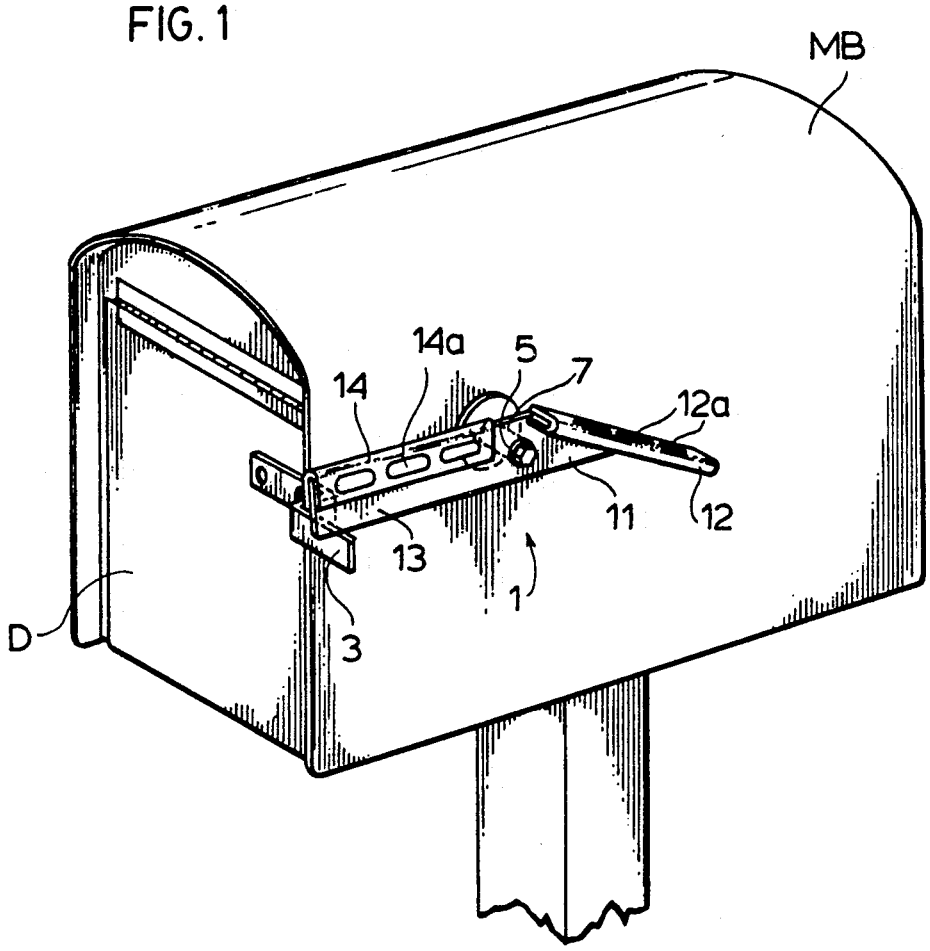
FIG. 1 is a perspective view of a mailbox fitted with an automatic flag according to a preferred embodiment of the present invention.
Figure 2:
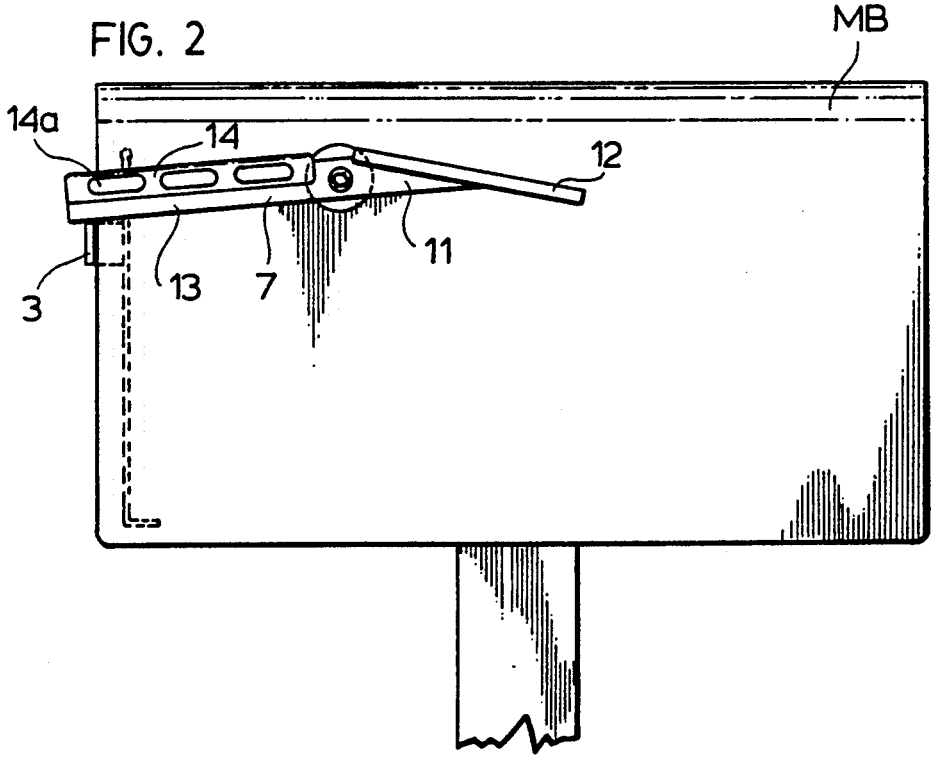
FIG. 2 is a side view of the mailbox of FIG. 1.

DETAILED DESCRIPTION ACCORDING TO THE PREFERRED EMBODIMENTS OF THE PRESENT INVENTION:

FIGS. 1 and 2 show a mailbox MB having a forward access door D. This is standard construction for a mailbox. In accordance with the present invention an automatic flag arrangement generally indicated at 1 has been fitted to the mailbox MB.

The automatic flag arrangement 1 includes a catch 3 which is fitted to the front door D and which extends out to one side of the mailbox MB. Mounted on that same side of the mailbox is a flag member 7. The flag member is secured by means of a pivotal connection and in this particular case, a sleeved bolt 5 which spaces the flag outwardly from the side of the mailbox secured positively, i.e. so that it won't fall off but preferably in a loose or sloppy manner for reasons to be described later in detail.

Figure 10:
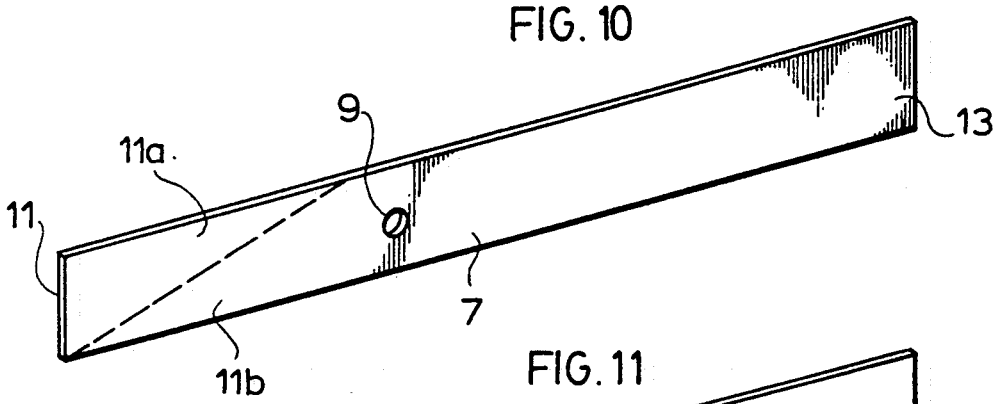
FIGS. 10 through 12 are perspective views showing the sequences used to form the flag of FIG. 9.
Figure 11:
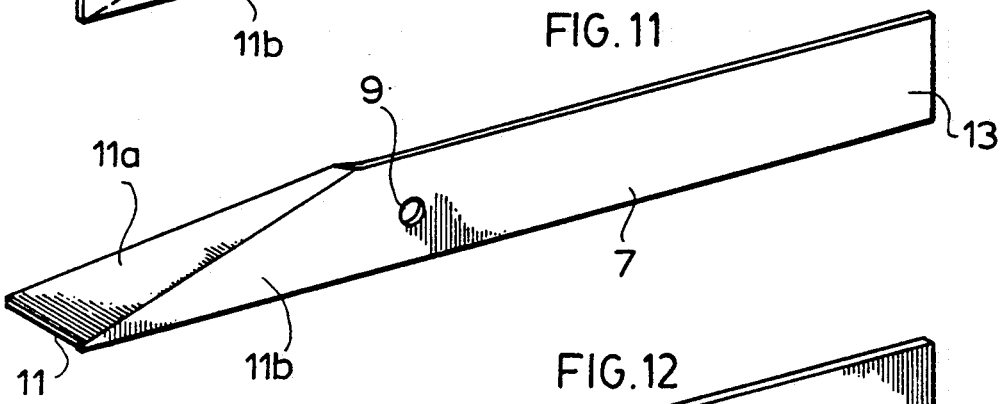
Figure 12:
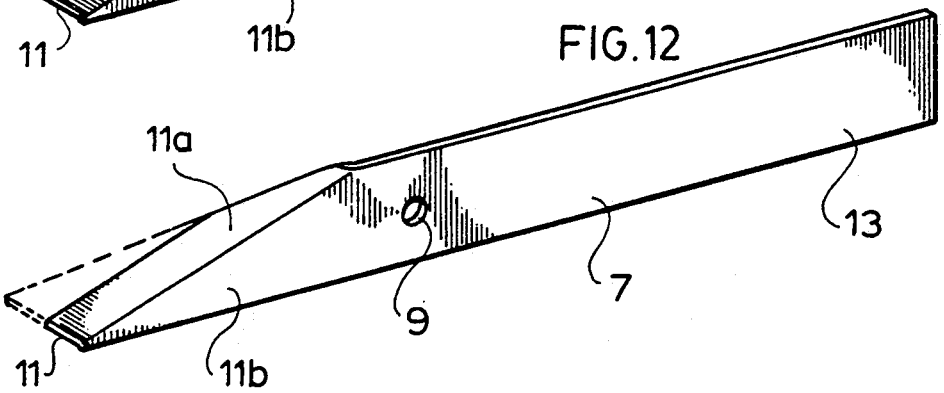

The construction of the flag itself is best seen having reference to FIGS. 10 through 12 of the drawings. The simplicity of this construction is one of the key features of the present invention.

The flag is initially formed from a simple thin flat bar of metal stock of consistent shape and weight from end to end of the bar. A mounting hole 9 is provided off-center in the bar so that when the bar is mounted it in effect has a short end 11 and a longer end 13.

The short end 11 of the bar is then bent giving it a right angle configuration formed by end portions 11*a* and 11*b*. The end portion 11*a* may then be cut as shown in FIG. 12 or it may be left in its FIG. 11 configuration. However, by cutting some of the material from the end 11, this further reduces its weight relative to the longer end 13 of the bar.

As will be understood from the above, even though the bar has a substantially even weight distribution over its entire length, when it is mounted to the mailbox by fitting bolt 5 through opening 9, there is a natural weight imbalance by virtue of the bar having longer and shorter ends. As noted immediately above, the weight imbalance can be further increased by removing material from the shorter end of the bar. Also to be noted is that no additional weights or the like have been added to the bar.

Figure 9:
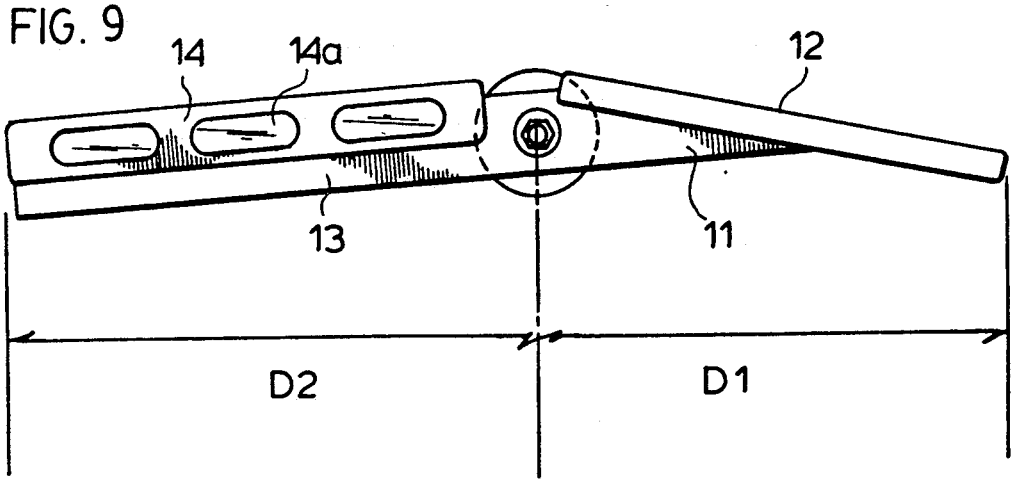
FIG. 9 is a side view of the flag from the mailbox of FIG. 1.

For increased visibility purposes, the bar may then be fitted with a pair of reflector members one on the long end of the bar and one on the short end of the bar as shown in FIG. 9. In particular, reflector member 14 is fitted to the long end 13 cf the bar and reflector member 12 is fitted to the short end of 11 of the bar. These reflector members which have a standard construction are the same as those which are fitted to the edge of a car door and comprise a plastic sleeve which simply slides onto the edge of the bar with the plastic sleeve carrying a plurality of reflectors. For example, reflector member 14 is fitted with actual reflectors 14*a*.

FIG. 1 shows how reflector member 14 fits to the edge of the longer bar end 13 while reflector member 12 including reflectors 12*a* slides onto the bent end portion 11*a* of the shorter end 11 of the bar. With this arrangement the two reflectors 12 and 14 are at right angles relative to one another for reasons also to be described later in detail.

In the embodiment shown, reflectors 12 and 14 are actually identical to one another. Therefore, they do not affect the desired weight imbalance in the bar. Furthermore, they are positioned on the bar such that the end 13 of the bar remains longer than the end 11 as indicated in FIG. 9 where the distance D2 is greater than the distance D1 on the bar.

The set up of the flag is best shown, again having reference to FIGS. 1 and 2 of the drawings. Prior to the mail being delivered, flag member 7 is set in a horizontally extending position where the longer end 13 of the flag zests atop the catch 3 extending out of from the mailbox door. In this position, the flag wants to tip downwardly but is prevented from doing so by the catch.

Figure 3:
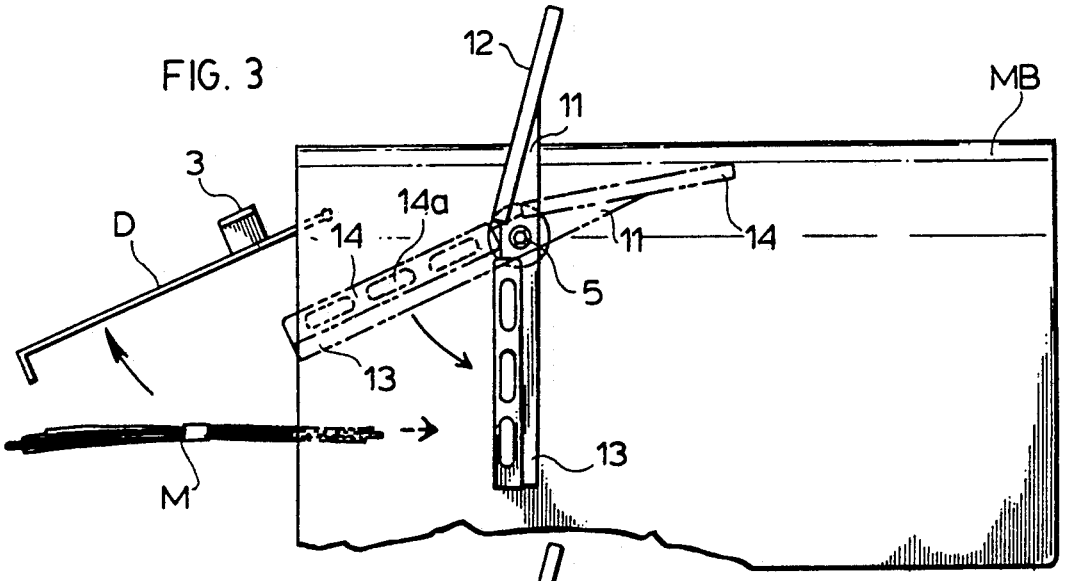
FIGS. 3 through 5 are further side views showing operation of the flag on the mailbox of FIGS. 1 and 2.

FIG. 3 shows mail M being inserted into the box. In order to do so, the door D must first be opened which pulls the catch 3 from beneath the flag which, because of its weight imbalance, then drops downwardly to the FIG. 4 position. Note that the flag is mounted in a position on the mail box such that shorter end 11 fitted with the reflector member 12 extends upwardly above the top of the box making it clearly visible to the home owner that the mail has been delivered.

Figure 4:
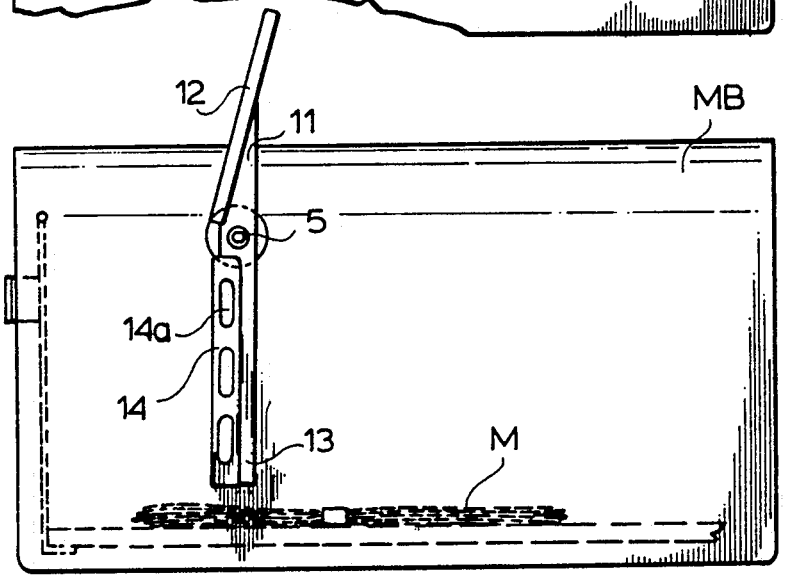

As earlier described, reflector members 14 and 12 sit at right angles relative to one another. When the flag is in its horizontal position, the reflectors 14*a* of reflector member 14 are clearly apparent from the side of the box which is the direction from which the mailman approaches the box. When the flag moves to its upright or vertical position as shown in FIGS. 3 and 4 of the drawings, the reflectors 12*a* of reflector member 12 are turned in a direction such that they are clearly evident from the front of the box which is visible to the home owner.

Figure 5:
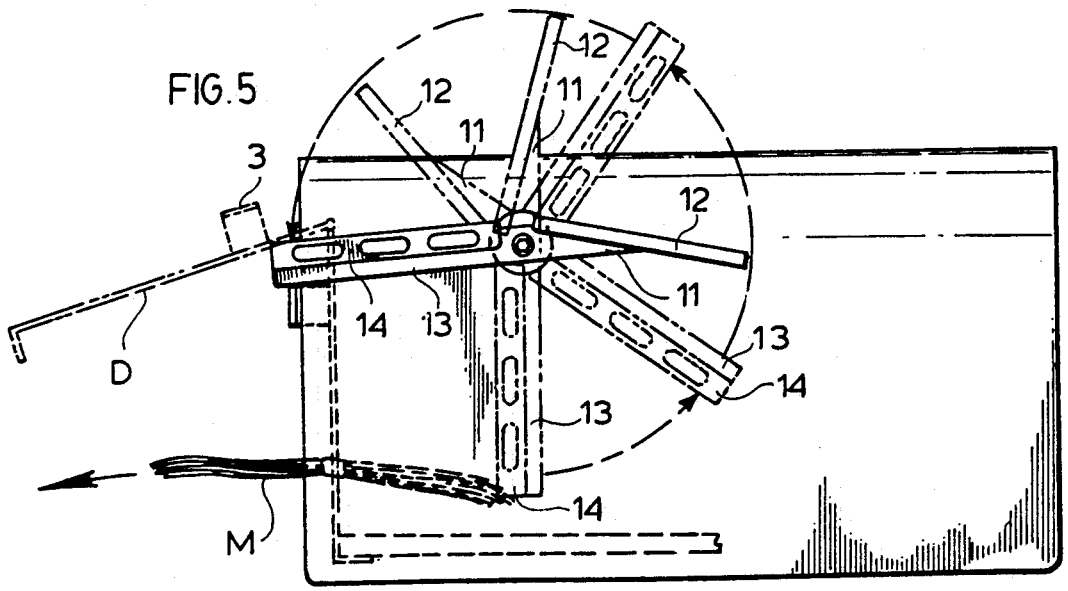
Figure 8:
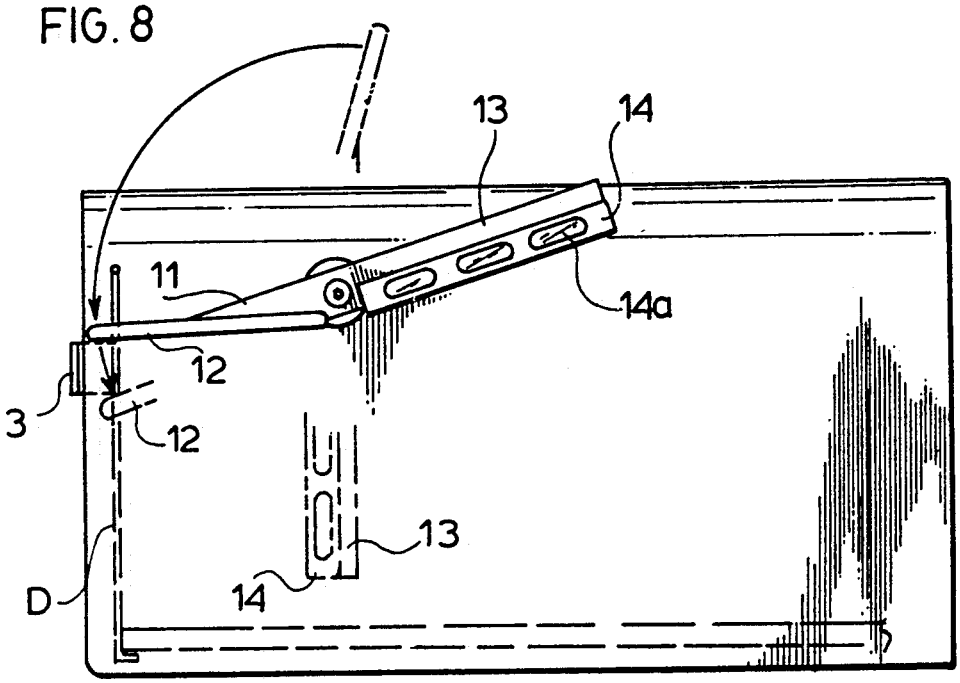
FIG. 8 is a further side view showing operation of the flag of the mailbox of FIG. 1.

FIG. 5 shows the handling of the mailbox as the mail M is being removed by the home owner. Again, the door D is opened to remove the mail and then the door is moved back down to its closed position. Prom here, the flag member is rotated from the FIG. 4 position through a 270° angle such that the longer end 13 of the flag again sits atop catch 3. Note that the shorter end of the flag is allowed to clear past the catch so that the door does not have to be held open in the resetting of the flag member. This is best seen in FIG. 8 of the drawings which shows the reflector member 12 on the short end 11 of the bar clearing past catch 3 while the flag member is being rotated back to the FIGS. 1 and 2 position.

Figure 6:
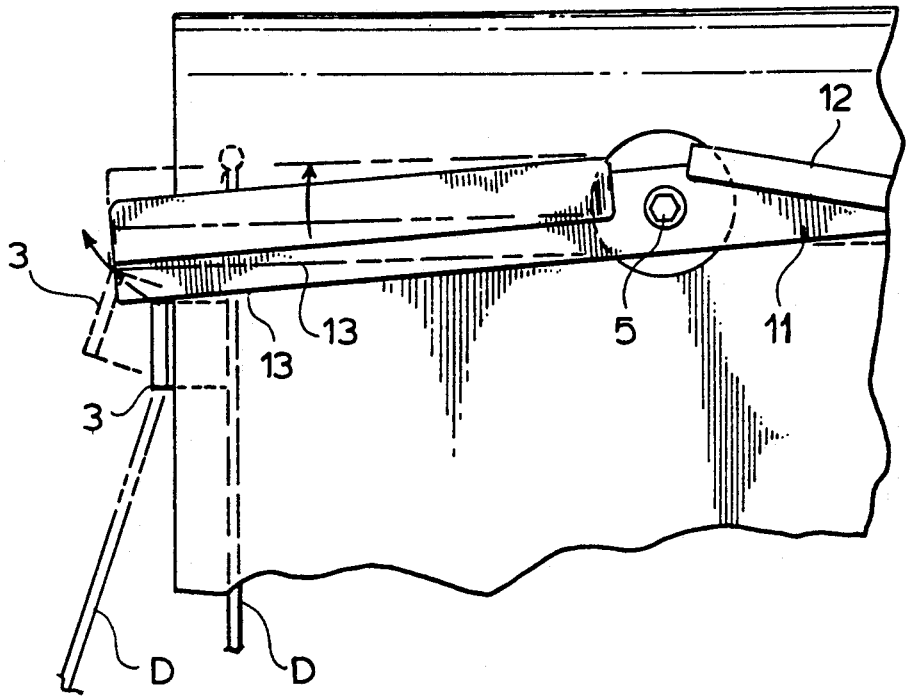
FIGS. 6 and 7 are enlarged side views showing the fitting of the flag to the catch on the door of the mailbox of FIGS. 1 and 2.
Figure 7:
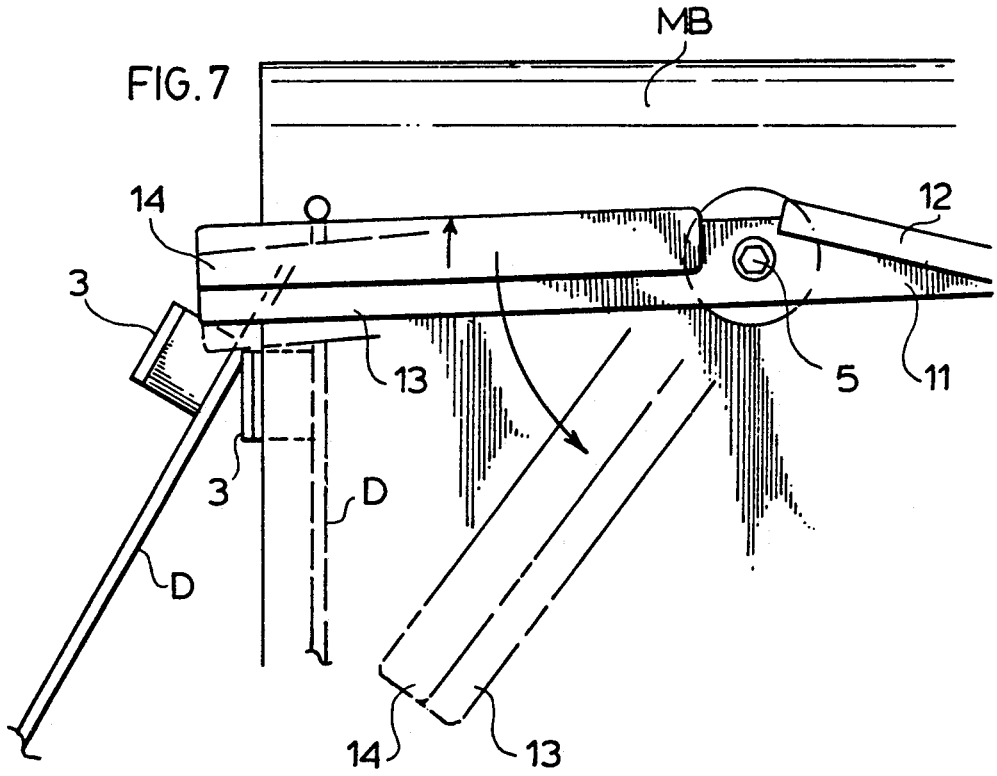

FIGS. 6 and 7 show a very interesting feature of the present invention which effectively provides an ice break in the event that the flag member does become iced up in a freezing rain or snow storm and the like. As will be seen in FIG. 6, when the door D is closed flag member 7 sits in its solid line position. With the initial opening of the door D, catch 3 pushes upwardly on the long end 13 of the flag member lifting it to the dotted line position for the flag shown in FIG. 6 of the drawings. This initial slight lifting of the flag breaks any ice that may otherwise hold the flag from pivoting downwardly after the catch is cleared completely beyond the end of the flag as shown in FIG. 7 where the long end of the flag is then allowed to drop downwardly moving the flag to its upright mail delivered indicating position.

As earlier described, the flag is positively secured to the mailbox in a relatively sloppy manner which is desired to once again assist in preventing any lock up which would otherwise not allow the flag to be freely movable on the mailbox.

As will be appreciated from the above, both the flag, its reflectors and the mounting components are all made with stock or standard hardware items resultinq in an inexpensive yet extremely functional construction of the automatic flag arrangement.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A mailbox with an automatic mailbox flag comprising an elongated arm of at least substantially uniform weight distribution from end to end of said arm, said arm being provided with a mounting opening off-center of said arm thereby providing a short arm end and a long arm end and said short arm end being bent to provide a flag portion on said arm, and both said long end and said short end of said arm being provided with reflectors, the reflector on said long end of said arm being visible from the side of said mail box, the reflector on said short end of said arm being mounted on said flag portion and being visible from the front of said mailbox.

2. A mailbox having a front opening door and an automatic mailbox flag indicating delivery of mail into said mailbox through said front opening door, said front opening door being provided with a sideways extending catch and said automatic mailbox flag comprising an elongated arm of at least substantially uniform weight distribution from end to end of said arm, said arm having an off-enter mounting to provide a long end and a short end on said arm, said short end of said arm being bent to provide a flag portion on said arm, said arm being mounted on said box such that said long end of said arm overhangs and engages said catch on said door holding said arm in a generally horizontal position and when said door is opened said catch pulling away from said long end of said arm whereby said arm pivots about said off-center mounting and rotates in a first direction through about 90 degrees such that said long end of said arm drops downwardly to move said arm to a vertical position with said flag portion located extending upwardly above said mailbox, said arm being resettable in the generally horizontal position with said door closed and said arm being free to rotate through about a further 270 degrees in said first direction until said long end of said arm again engages said catch.

3. A mailbox as claimed in claim 2, wherein said door opens upwardly and said long end of said arm overhangs said catch to the extent that upon initial opening of said door, said catch first pushes upwardly on and then pulls away from said long end of said arm.

* * * * *